United States Patent [19]

Rembold et al.

[11] Patent Number: 5,005,548

[45] Date of Patent: Apr. 9, 1991

[54] FUEL INJECTION PUMP

[75] Inventors: Helmut Rembold, Stuttgart; Hannes Pflug, Weilderstadt; Wilhelm Christ, Ludwigsburg; Hans-Joachim Siebert, Schwieberdingen; Ewald Eblen, Stuttgart; Rodriguez-Amaya, Stuttgart; Helmut Laufer, Gerlingen; Alfred Schmitt, Ditzingen; Werner Pape, Magstadt, all of Fed. Rep. of Germany; Dominique Buisson, Venissieux, France; Pierre Lauvin, Francheville, France; Detlev Potz, Stuttgart-Nord, Fed. Rep. of Germany; Nikolaus Simon, Murnau A Staffelsee, Fed. Rep. of Germany; Jean Pigeroulet, Villeurbanne, France; Anton Karle, Villingen, Fed. Rep. of Germany

[73] Assignee: Robert Bosch GmbH, Stuttgart, Fed. Rep. of Germany

[21] Appl. No.: 542,125

[22] Filed: Jun. 22, 1990

[30] Foreign Application Priority Data

Jul. 6, 1989 [DE] Fed. Rep. of Germany ..... 3922231

[51] Int. Cl.[5] ..... F02M 41/00

[52] U.S. Cl. ..... 123/450; 123/447; 123/300; 123/506

[58] Field of Search ..... 123/299, 300, 447, 449, 123/450, 458, 502, 506

[56] References Cited

U.S. PATENT DOCUMENTS

| | | | |
|---|---|---|---|
| 4,401,082 | 8/1983 | LeBlanc | 123/447 |
| 4,409,939 | 10/1983 | Eheim | 123/447 |
| 4,498,442 | 2/1985 | Tissot | 123/447 |
| 4,526,149 | 7/1985 | Häfele | 123/447 |
| 4,530,337 | 7/1985 | Laufer | 123/300 |
| 4,535,742 | 8/1985 | Laufer | 123/447 |
| 4,601,274 | 7/1986 | Seilly | 123/458 |
| 4,696,271 | 9/1987 | LeBlanc | 123/299 |
| 4,881,504 | 11/1989 | Best | 123/447 |

*Primary Examiner*—Carl Stuart Miller
*Assistant Examiner*—Erick Solis
*Attorney, Agent, or Firm*—The firm of Edwin E. Greigg

[57] ABSTRACT

A fuel injection pump is proposed in which over a first portion of the supply stroke of the pump piston fuel for the main injection is pumped via a distributor line and a distributor groove into one at a time of a plurality of fuel injection lines. In a second, remaining portion of the pump piston supply stroke, on the same cam flank, fuel is then pre-stored in a reservoir, controlled by a first electrically controlled valve and a second electrically controlled valve and by one of a plurality of longitudinal control grooves, which fuel subsequently, before the beginning of the next main injection determined by the closure of the first electrically controlled valve, is pumped via a second distributor line into the next succeeding injection line.

19 Claims, 5 Drawing Sheets

FUEL INJECTION PUMP

BACKGROUND OF THE INVENTION

The invention relates to a fuel injection pump for internal combustion engines as generically defined hereinafter. In a fuel injection pump of this kind, known from German Offenlegungsschrift 37 22 265, in order to divide the fuel injection quantity into a preinjection quantity and a main injection quantity, the high-pressure supply stroke is controlled by the first electrically controlled valve. This is accomplished by means of the closure of the line leading from the pump work chamber to a fuel supply chamber that is at low pressure; to thereby interrupt the high-pressure supply to the respective fuel injection nozzle, the initially closed second electrically controlled valve is then opened between the preinjection and the main injection, to thus enable a withdrawal of fuel into the reservoir chamber that lowers the supply pressure to below the injection valve opening pressure. Thus, upon the opening of the second electrically controlled valve, the preinjection is interrupted, and the main injection is begun once the withdrawal has ended. To this end, the second electrically controlled valve controls the relief of the rear side of the adjustable wall, which is thus blocked in terms of its deflection motion when the valve is closed.

This version has the disadvantage that the control of the preinjection quantity and of the main injection quantity is influenced by the control of the quantity transferred to the reservoir; in particular, the reservoir volume must determine not only the angular interval between the preinjection quantity and the main injection quantity but the magnitude of the preinjection quantity as well. The fact that the duration of fuel withdrawal in the high-pressure supply phase of the pump piston is rpm-dependent also must be taken into account. A further disadvantage is that the main injection is effected at a relatively high injection rate, because the middle, steeply ascending region of the cam is involved in the drive, which is operative in this range, of the pump piston by the drive cam.

OBJECT AND SUMMARY OF THE INVENTION

The fuel injection pump according to the invention, has the advantage over the prior art that the main injection can be effected immediately upon the beginning of the piston stroke, regardless of the magnitude and interval of the preinjection, and as a result a lower pump piston supply rate is available upon injection onset. In addition, and advantageously, the injection onset of the main injection can be adjusted, instead of by the first electrically controlled valve, by a different injection adjusting device instead, such as a hydraulically actuated injection adjusting device. As a result, rpm dependencies, which are major factors given the defined switching times of electrically controlled valves, play only a limited role in the dimensioning of the particular injection quantity. In fact, the injection onset determines the piston stroke. The only possible rpm-dependent source of error is the switching time that the electric valve needs to open or close. Thus, preinjection is advantageously completely uncoupled from the main injection; preinjection is possible in all operating ranges of the engine.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
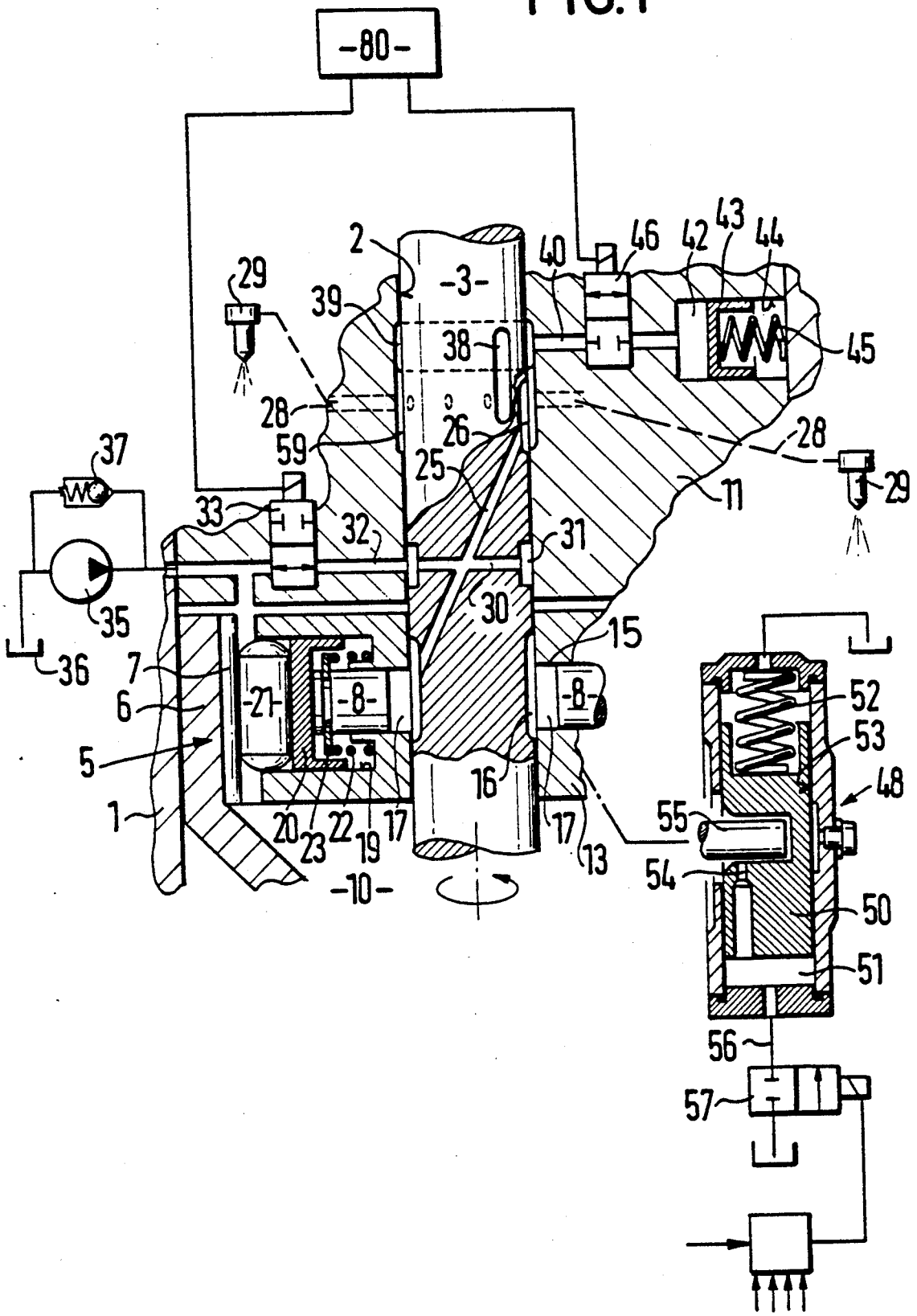
FIG. 1 is a fragmentary section through a fuel injection pump of the distributor pump type shown partly symbolically, with a distributor and two of a plurality of pump pistons located radially to it.

FIG. 1 is a section taken through part of a distributor fuel injection pump of the radial piston type. In the housing 1 of this fuel injection pump, only part of which is shown, a distributor cylinder 2 is provided, in which a distributor 3 is guided that is driven in rotation in synchronism with the engine by a pump piston drive mechanism, not otherwise shown. A cam drive 5 having a cam ring 6, which has a radially inwardly oriented cam race 7 with drive cams for pump pistons 8, is also provided in the housing 1. The cam ring is driven synchronously with the engine in the same manner as the distributor, and once again the drive mechanism, because it is known, is not shown in detail. The part of the cam ring carrying the cam race is guided on the circumference in the housing 1.

Toward the cam ring 6, the distributor 3 protrudes outward into the interior 10 and out of an upper part 11 of the housing, which closes off a fuel-filled interior 10. There, in the region coinciding with the cam race, a piston carrier part 13 is rotatably guided on the distributor. This is provided if a mechanism or electromechanical adjustment of the injection timing is to be performed on the pump, as schematically shown in FIG. 1. If an adjustment of the injection onset of this kind is not necessary, then the piston carrier part may be in one piece with the upper housing part 11.

In the piston carrier part 13, radial bores 15 are provided, in a plane radial to the distributor, in each of which one pump piston 8 is tightly and displaceably disposed. The radial bores 15 discharge into a first annular groove 16 provided on the jacket face of the distributor; this groove joins the pump work chambers 17 enclosed between the end face of each pump piston and the distributor with one another. The end of the pump piston remote from the distributor 3 protrudes out of the respective radial bores 15 into a guide bore 19 adjoining it coaxially and in which a tappet 20 is displaceable; in a guide on its end toward the cam race 7, the tappet 20 has a respective roller 21, which is also laterally guided in the guide bore 19. The pump piston 8 is kept in contact with the tappet 20 via a compression spring 22, which is supported on a spring plate 23 clipped into the pump piston on the end toward the tappet. On the other end, the spring 22 is supported on the piston carrier part 13. To avoid interfering forces, the piston carrier part may also be embodied in two parts, with an inner annular part that receives the radial bores, and an outer part guided in the housing adapted to receive the guide bores for the tappets. The parts are coupled to one another by a coupling tang, as disclosed in German Patent Document Al 3 612 942, so that they are rotatable in common.

A distributor line 25 begins at the first annular groove 16 in the distributor and leads to a distributor opening 26 on the jacket face of the distributor. The distributor opening is in the form of a short longitudinal groove and is located in the vicinity of injection lines 28 leading away from the distributor cylinder. These lines are located in a plane that is radial to the distributor, are distributed uniformly over the circumference of the distributor cylinder in accordance with the fuel pumping or injection sequence, and each line leads to one injection valve 29 on the engine supplied by the fuel injection pump. Also branching off from the distributor line is a transverse bore 30, which leads into a second annular groove 31 on the circumference of the distributor. A line 32 discharges into the vicinity of this annular groove 31 and a first electrically controlled valve 33 is associated therewith; thus the line 32 communicates with the pumping side of a fuel feed pump 35. This pump aspirates fuel from a fuel supply container 36 and is driven at synchronous rpm with the engine; an rpm-dependent pressure is controlled with the aid of a pressure control valve 37 located in a bypass around the fuel feed pump 35. The pump interior 10 is also connected directly to the supply side of the fuel feed pump 35, so that an rpm-dependent interior pressure is established there as well.

In addition to the longitudinal distributor groove 26, a control groove 38 is provided on the jacket face of the distributor, and it can be adapted to coincide with the injection lines 28 in the course of distributor rotation. The control groove 38 also includes a portion which is in continuous communication with an annular groove 39 in the wall of the distributor cylinder. From this annular groove 39, a pressure line 40 leads away in the upper housing part 11 to a reservoir chamber 42, which is defined on one side by an adjustable wall 43. A piston which is tightly and displaceably mounted in a cylinder bore 44 serves as the adjustable wall, and on the side opposite the entry of the pressure line 40 into the reservoir chamber 42 this element is acted upon by a restoring spring 45. The part of the cylinder 44 for receiving the restoring spring is pressure-relieved. A second electrically controlled valve 46 is also provided in the pressure line 40 between the distributor cylinder 2 and the reservoir chamber 42; this valve controls a connection between the reservoir chamber 42 and the pump work chamber 17, 16 for a particular position of the distributor.

Also visible in FIG. 1 is an injection onset adjuster 48, comprising an adjusting piston 50, which on one end face defines a work chamber 51 and on the other is acted upon by a restoring spring 52, by means of which the adjusting piston is tightly displaceable in a cylinder 53. The work chamber 51 communicates via a throttle bore 54 with the interior 10 and is thus exposed to the rpm-dependent pressure, as a function of which it is displaced counter to the restoring spring 52 with increasing rpm. A shaft 55 is connected to the adjusting piston 50 and on its other end is coupled, in a manner not shown here in detail, to the piston carrier part 13. If the adjusting piston 50 is now adjusted with increasing rpm, then at the same time the piston carrier part 13 is also rotated, and the pump pistons each execute their supply stroke, each at an earlier instant with respect to a predetermined rotational position of the distributor. The pressure in the work chamber 51 can be also relieved as a function of operating parameters through a relief line 56 by an electrically controlled valve 57, so that other operating parameters besides the rpm can also act upon the instant of injection here. In principle, however, the injection onset also can be determined solely by the control times of the first electrically controlled valve 33.

In the jacket face of the distributor cylinder 2, toward the distributor drive mechanism, longitudinal control grooves 59 lead away from the annular groove 39 at regular intervals, corresponding to the rotational angle intervals of the pump piston supply strokes per revolution of the cam ring or distributor; specifically, these grooves 59 are located in the regions between the branches of the injection lines 28, at a fixed rotational angle interval from them. The association of these cross sections, and of the other control grooves and annular grooves on the distributor and distributor cylinder, are more clearly shown in the developed view of FIG. 2. Here, three operating phases a–c of the fuel injection pump are shown in succession, with a varying association between the control groove 38 and distributor control groove 26, on the one hand, and the injection lines 28 and longitudinal control grooves 59, on the other. The views in FIGS. 2*a–c* correspond to the views of FIGS. 3*a–c;* a basic drawing which shows the three operating phases in the form of a section through the longitudinal axis of the distributor. The illustration is supported by the diagrams a–f of FIG. 4. The mode of operation of the fuel injection pump will now be described, in conjunction with these illustrations.

Figure 3C:
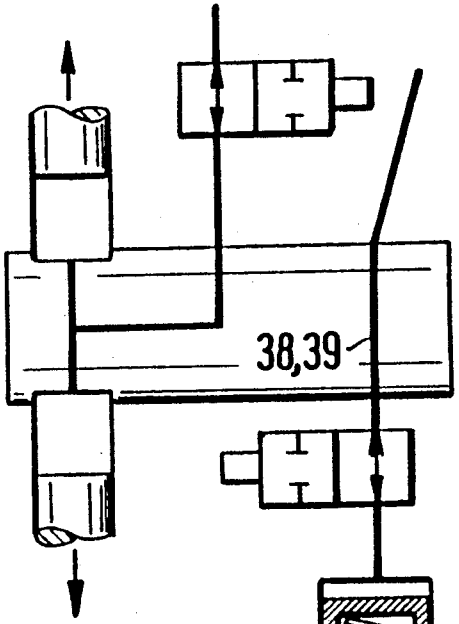
FIGS. 3*a*–3*c* show various functional phases of the fuel injection pump of FIG. 1 in principle.
Figure 3B:
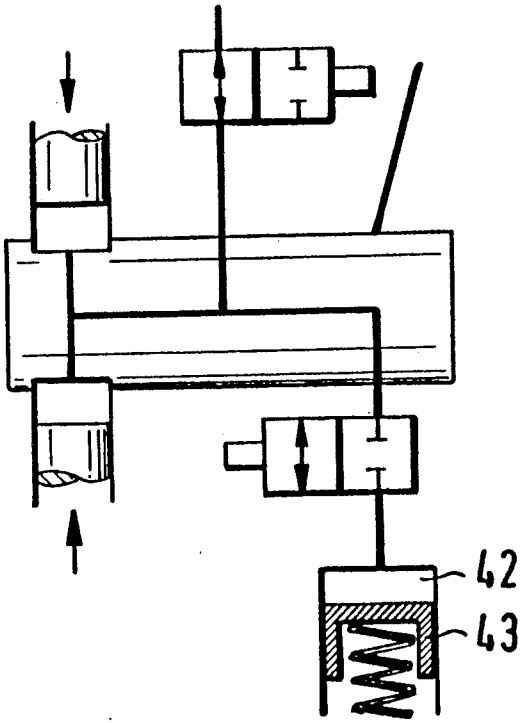
Figure 3A:
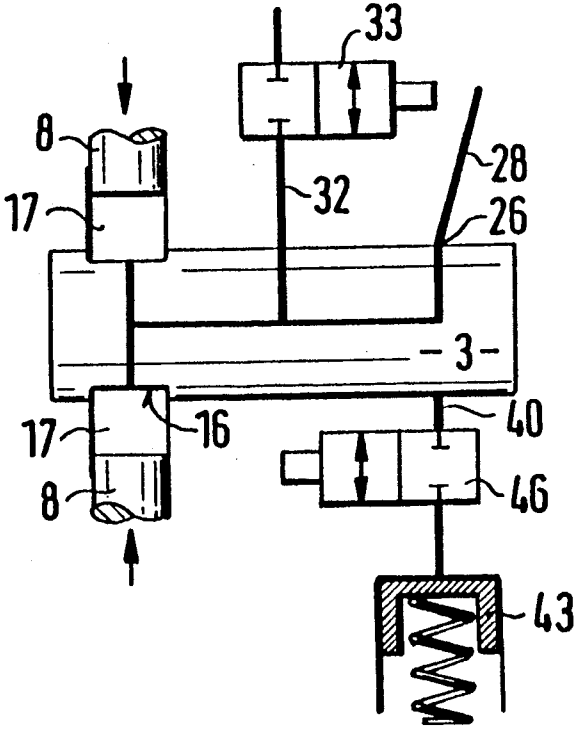
Figure 4:
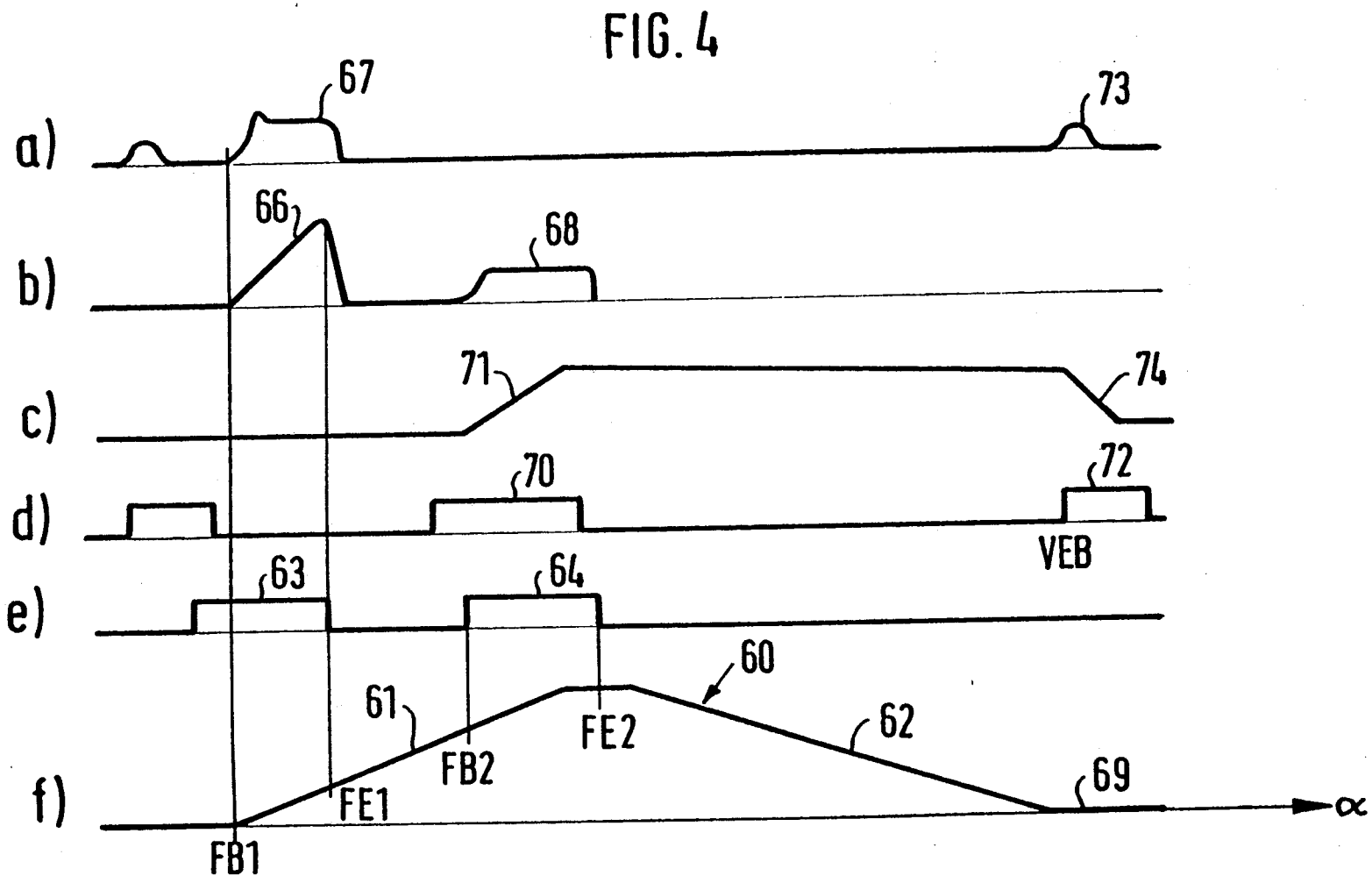
FIGS. 4*a*–4*f* show various functional and control diagrams to explain the above functional phases of FIG. 3.

During operation, the cam ring is set into rotation and permits the rollers 21 to follow along the cam race. Correspondingly, the pump pistons 8 can also move inward or outward depending on the cam course. In their outward motion, corresponding to an outward-leading cam flank of the cam race 7, the pump pistons execute their intake stroke. At that instant, the first electrically controlled valve is open, and fuel can flow via the line 32, the second annular groove 31, the transverse bore 30 and the distributor line 2 to reach the annular groove 16; from there it reaches the pump work chambers 17. In the diagram of FIG. 4*f*, the cam lobe curve 60 is schematically shown, with an ascending flank 61, in which the rollers 21 along with the tappet 23 and pump pistons 8 are moved radially inward, and a descending flank 62, in which the pump pistons are executing the aforementioned intake stroke, moving outward. The control diagram 4*e*, above this cam lobe curve, shows a first closing phase 63 and a second closing phase 64 of the first electrically controlled valve 33, over the duration of which the line 32 is closed, so that during a first supply stroke portion, determined by the first closing phase 62, from the supply onset 1 (FB1) to the end of supply (FE1), fuel is pumped at high pressure to one of the injection valves and attains injection. Since the supply stroke of the pump piston cannot occur until the beginning of the cam lobe, FB1 is located chronologically after the closing point of the first closing phase 63 of the electrically controlled valve 33. During this first supply stroke portion, the pump pistons pump fuel at high pressure into the distributor line 25, and into the distributor groove 26, and from there into one of the injection lines 28. This can be seen from the course shown in the diagram of FIG. 4*b* for the pressure 66, which indicates the pressure prevailing in the work chamber over the rotational angle. In accordance with this pressure the nozzle needle opening stroke 67 for the associated fuel injection nozzle 29 results, as indicated by the curve in FIG. 4*a* above the rotational angle $\alpha$. This situation is also shown in FIG. 3*a*, with a closed first valve 33. At that instant, the pressure line 40 communicates with neither the pump work chamber nor one of the injection lines 28. From curve 4*d*, it can be seen that over this period of time the second electrically controlled valve 46 is closed as well, because the base line of this characteristic curve course is definitive for the closing state. Correspondingly, the piston 43 is not in motion at all.

As the rotation of the distributor and the simultaneously occurring drive of the pump pistons continue, the point FE1 is followed by a phase in which the first electrically controlled valve 33 is opened, and the pump pistons pump the positively displaced fuel into the interior 10 of the pump via the distributor line 25, the transverse bore 30 and the line 32. Not until time FB2, toward the end of the pump piston stroke, is the first electrically controlled valve brought into the second closing phase 64. As can be seen from the diagram in FIG. 4*b*, the result again is a pressure increase 68 in the pump work chamber. No later than time FB2, that is, the beginning of the second pressure pumping phase or the second remaining supply stroke part of the pump piston, is the pressure line 40 opened by the second electrical valve 46 over a first opening phase 70, and the distributor groove 26 has attained communication with one of the longitudinal control grooves 59, so that communication is now established between the pump work chamber and the reservoir chamber 42. The fuel consequently positively displaced by the pump piston is now pumped into the reservoir chamber 42, as indicated by the line in FIG. 4*c*, with the rise 71. Correspondingly, the adjustable wall 43 deflects counter to the force of the spring 45. The second closing phase 64 of the first electrically controlled valve continues up to point FE2, which is in the vicinity of top dead center of the cam lobe curve 60. At that instant, the first opening phase 70 of the second electrically controlled valve 46 is ended. The entire system is thus at a relatively high pressure level. This situation can also be seen from FIG. 2*c*.

Figure 2A:
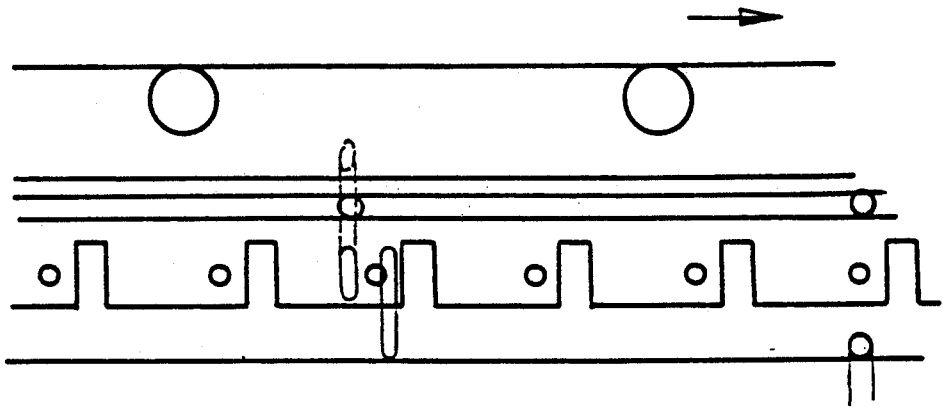
FIGS. 2*a*–2*c* show a developed view of the jacket face of the distributor of FIG. 1, and above it a developed view of the cylinder carrying this distributor, in various functional phases of the fuel injection pump.
Figure 2B:
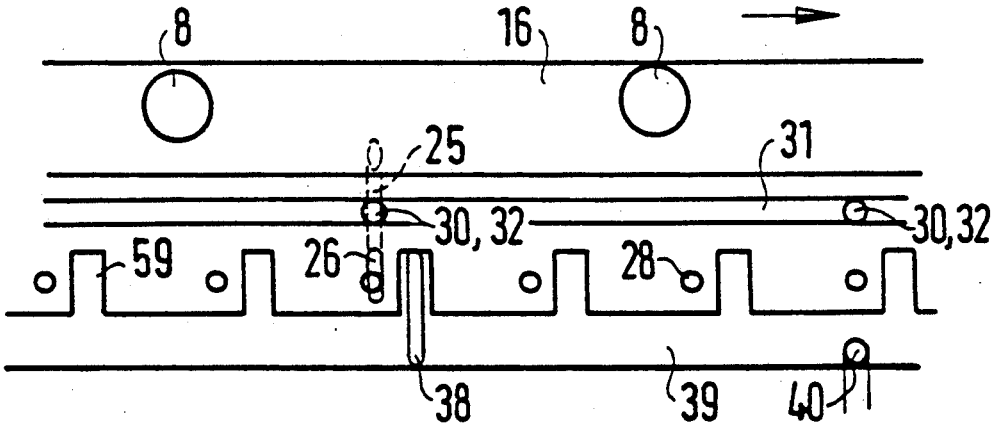
Figure 2C:
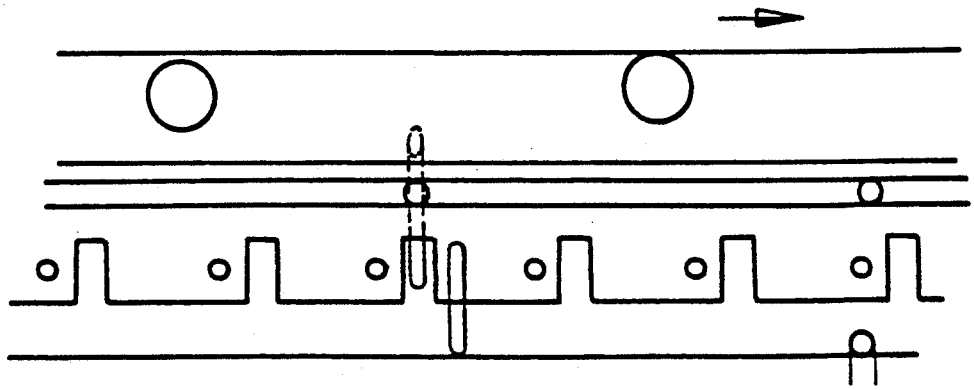

As the rotation of the cam ring continues, the pump pistons can now move outward again and execute an intake stroke. To this end, the second closing phase 64 of the first electrically controlled valve is now ended at top dead center, and the fuel flows via the line 32 into the pump work chamber. The reservoir chamber 42 remains at a high pressure level and with a high fill ratio, because of the now closed second electrically controlled valve 46. This phase can be seen in FIG. 3*b*. The distributor groove 26 also moves away from the state of coincidence with the corresponding longitudinal control groove 59. Once the pump pistons have rolled off on the descending flank 62 and entered a detent 69 of the cam race, the second electrically controlled valve 46 is then opened, as shown in FIG. 4*d*. This second opening phase 72 begins at the point VEB. At that instant, as shown in FIG. 2*a*, the distributor groove 26 is closed, but the control groove 38 communicates by one end with the injection line 28 that is triggered for the next high-pressure injection. The control groove then connects the injection line 28 to the annular groove 39 and thus represents a second distributor line, by way of which the injection lines are triggered in alternation for the preinjection. In accordance with the second opening phase 72, a second nozzle needle opening stroke 73 now results, by way of which the preinjection into the next cylinder in succession takes place. The volume of the reservoir chamber 42 correspondingly drops over a descending flank 74 of the curve course in FIG. 4*c*. This operating phase is also shown in FIG. 3*c*. FIG. 3*c* shows the opened first electrically controlled valve 33 and the opened second electrically controlled valve 46, by way of which along with the second distributor line 39, 38 and the injection line 28 the connection is established between the reservoir 42 and the injection nozzle 29.

Finally, FIG. 2 also shows the association of the control cross sections in the operating phase of FIG. 3*a*, in which the main injection takes place again in the ensuing first part of the supply stroke of the pump piston.

It can be seen that upon each main injection, only the descending flank of the first electrically controlled valve 33, as a supply duration component that varies as a function of rpm, is a source of error. The supply onset is determined by the ascending flank 61 of the cam lobe curve and is not subject to any rpm error.

Equally well, the second electrically controlled valve 46 is already opened when the second, remaining portion of the pump piston supply stroke begins by the closure of the first electrically controlled valve 33. Only this closing flank is in the final analysis another source of rpm-dependent error. The opening flank in the vicinity of top dead center, contrarily, is not a source of error, because the end of supply is defined by the attainment of top dead center. The first opening phase 70 of the second electrically controlled valve extends in principle over this period of time. The duration of the preinjection, contrarily, can be again determined by the beginning of coincidence of a control edge, namely the control groove 38, with the injection line opening 28, while the end is determined by the closing flank of the second electrically controlled valve.

Figure 5:
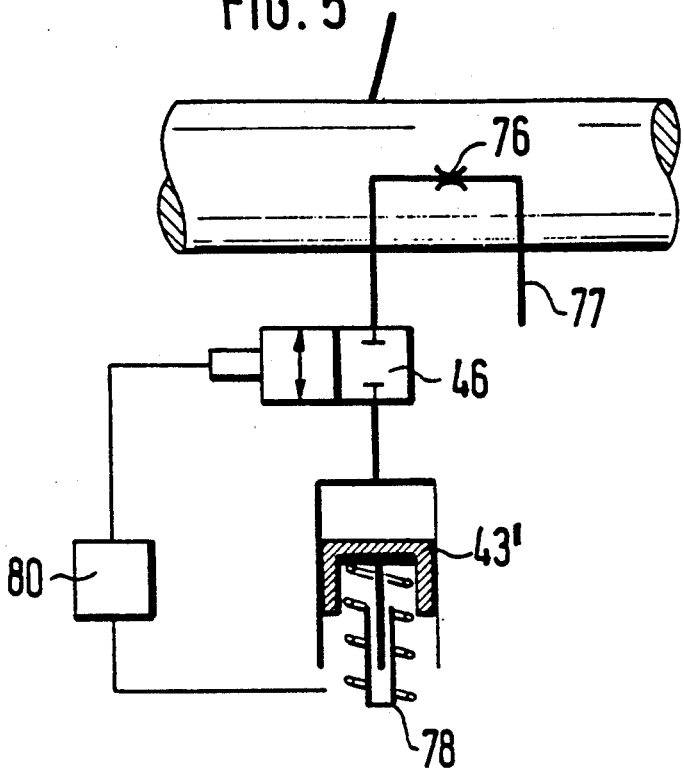
FIG. 5 shows an alternative embodiment of the reservoir.
Figure 6:
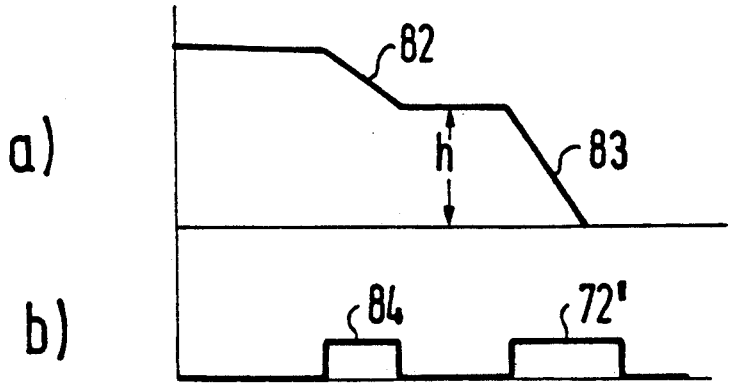
FIG. 6 shows an alternative control for metering the preinjection quantity based on the version of FIG. 5.

In a modification of the above exemplary embodiment, however, as shown in FIG. 5 the reservoir chamber 42 can be relieved, via a relief throttle 76 and a corresponding relief line 77, by opening of the second electrically controlled valve 46 in the range between FE2 and VEB, until a residual stroke of the adjustable wall 43' is attained that determines the preinjection quantity that actually attains injection. The stroke of the adjustable wall 43' is measured by a travel transducer 78, which is connected with a corresponding control device 80 that also determines the switching times of the first electrically controlled valve 33 and second electrically controlled valve 46. As FIG. 6*a* shows, a modification of the stroke course of FIG. 4*c* results for the movable wall 43'. FIG. 6*b* shows the associated diagram for the opening times of the second electrically controlled valve 46 in a modification of FIG. 4*d*. Once the reservoir chamber 42 has been completely filled with the quantity of fuel pumped during the particular remaining portion of the pump piston supply stroke, the reservoir chamber is now relieved until a predetermined stroke h along the curve 82. By opening of the second electrically controlled valve 46, which is closed again after this intermediate opening over a third opening phase 84 and is not reopened until the time VEB, so that the entire remaining fuel content of the reservoir is now delivered to the preinjection, as represented by curve 83 and the second opening phase 72'. The piston 43 then attains its outset position, as shown for instance in FIG. 3*a*. The result is exact metering of the preinjection quantity, and accurate injection times which also can be varied.

Advantageously, the preinjection and main injection can be effected by the same injection opening at a given injection valve via a two-spring injection valve, known per se.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having at least one pump piston (8) defining a pump work chamber (17), said piston adapted to be driven by a cam drive (5) for executing an intake stroke and a supply stroke, said pump work chamber arranged to communicate, via a distributor line (25, 26) disposed in rotatingly driven distributor (3), in alternation with injection lines (28) which extend from a circumference of the distributor to injection locations, upon the supply stroke of the pump piston, a line (32) associating the pump work chamber (17) with a fuel supply chamber (10) which is at low pressure and the cross section of which supply chamber is controlled by a first electrically controlled valve (33), and a closing duration of said valve determining a duration of a high-pressure pumping of fuel by the pump piston, said distributor having a line (25, 26) adapted to communicate said pump work chamber through a pressure line (40) with a reservoir chamber (42) defined by a wall (43) which is adjustable counter to a restoring force, a second electrically controlled valve adapted to control a deflection motion of said adjustable wall (43), said first electrically controlled valve (33) adapted to be closed per pump piston supply stroke over a first portion (FB1–FE1) of the supply stroke of the pump piston to determine a main injection, and closed over a second remaining supply stroke portion (FB2–FE2) of the pump piston, during which at least the pressure line (40) to the reservoir chamber (42) is opened by the second electrically controlled valve (46), by means of which valve a second distributor line (39, 38) in the distributor (3) can be opened after the end of the remaining supply stroke and before the beginning of the ensuing first portion of the supply stroke, and the reservoir (42) communicates over the duration of a preinjection with the injection line (28) during the ensuing first supply stroke portion via the first distributor line (25).

2. A fuel injection pump as defined by claim 1, in which said line of the distributor (25) is disposed in the distributor (3) and discharges via a distributor opening (26) on the circumference of the distributor (3), said opening (26) adapted to be connected to said pressure line (40) leading to said reservoir (42) upon the rotation of the distributor (3).

3. A fuel injection pump as defined by claim 2, in which said second distributor line (38) is disposed in the distributor (3) and in alternation upon the rotation of said distributor the reservoir (42) is connected to the injection lines (28) one at a time.

4. A fuel injection pump as defined by claim 1, in which the pump work chamber (17) communicates during an intake stroke with the fuel supply chamber (10, 35) via the first electrically controlled valve (33).

5. A fuel injection pump as defined by claim 2, in which the pump work chamber (17) communicates during an intake stroke with the fuel supply chamber (10, 35) via the first electrically controlled valve (33).

6. A fuel injection pump as defined by claim 3, in which the pump work chamber (17) communicates during an intake stroke with the fuel supply chamber (10, 5) via the first electrically controlled valve (33).

7. A fuel injection pump as defined by claim 1, in which during said second portion of the supply stroke of the pump piston (8) and until the end of the pump piston supply stroke which it attains in its extreme deflected position, the first electrically controlled valve (33) is closed, and the second electrically controlled valve (46) is opened.

8. A fuel injection pump as defined by claim 2, in which during said second portion of the supply stroke of the pump piston (8) and until the end of the pump piston supply stroke which it attains in its extreme deflected position, the first electrically controlled valve (33) is closed, and the second electrically controlled valve (46) is opened.

9. A fuel injection pump as defined by claim 3, in which during said second portion of the supply stroke of the pump piston (8) and until the end of the pump piston supply stroke which it attains in its extreme deflected position, the first electrically controlled valve (33) is closed, and the second electrically controlled valve (46) is opened.

10. A fuel injection pump as defined by claim 4, in which during said second portion of the supply stroke of the pump piston (8) and until the end of the pump piston supply stroke which it attains in its extreme deflected position, the first electrically controlled valve (33) is closed, and the second electrically controlled valve (46) is opened.

11. A fuel injection pump as defined by claim 5, in which during said second portion of the supply stroke of the pump piston (8) and until the end of the pump piston supply stroke which it attains in its extreme deflected position, the first electrically controlled valve (33) is closed, and the second electrically controlled valve (46) is opened.

12. A fuel injection pump as defined by claim 7, in which the fuel volume received for injection in the reservoir chamber (42) is controlled via the second electrically controlled valve (46) and a sequentially disposed throttle (76) is connected in the discharge direction from the reservoir chamber (42) to a relief chamber said throttle being controllable prior to the beginning of the preinjection by a partial emptying of the reservoir chamber (42) that is detected by a transducer (78) adapted to measure the stroke of the adjustable wall (43), said regulation being performed in accordance with the measured value and as a function of other operating parameters of the engine.

13. A fuel injection pump as defined by claim in which the fuel volume received for injection in the reservoir chamber (42) is controlled via the second electrically controlled valve (46) and a sequentially disposed throttle (76) is connected in the discharge direction from the reservoir chamber (42) to a relief chamber said throttle being controllable prior to the beginning of the preinjection by a partial emptying of the reservoir chamber (42) that is detected by a transducer (78) adapted to measure the stroke of the adjustable wall (43), said regulation being performed in accordance with the measured value and as a function of other operating parameters of the engine.

14. A fuel injection pump as defined by claim 9, in which the fuel volume received for injection in the reservoir chamber (42) is controlled via the second electrically controlled valve (46) and a sequentially disposed throttle (76) is connected in the discharge direction from the reservoir chamber (42) to a relief chamber said throttle being controllable prior to the beginning of the preinjection by a partial emptying of the reservoir chamber (42) that is detected by a transducer (78) adapted to measure the stroke of the adjustable wall (43), said regulation being performed in accordance with the measured value and as a function of other operating parameters of the engine.

15. A fuel injection pump as defined by claim 10, in which tho fuel volume received for injection in the reservoir chamber (42) is controlled via the second electrically controlled valve (46) and a sequentially disposed throttle (76) is connected in the discharge direction from the reservoir chamber (42) to a relief chamber said throttle being controllable prior to the beginning of the preinjection by a partial emptying of the reservoir chamber (42) that is detected by a transducer (78) adapted to measure the stroke of the adjustable wall (43), said regulation being performed in accordance with the measured value and as a function of other operating parameters of the engine.

16. A fuel injection pump as defined by claim 11, in which the fuel volume received for injection in the reservoir chamber (42) is controlled via the second electrically controlled valve (46) and a sequentially disposed throttle (76) is connected in the discharge direction from the reservoir chamber (42) to a relief chamber said throttle being controllable prior to the beginning of the preinjection by a partial emptying of the reservoir chamber (42) that is detected by a transducer (78) adapted to measure the stroke of the adjustable wall (43), said regulation being performed in accordance with the measured value and as a function of other operating parameters of the engine.

17. A fuel injection pump as defined by claim 1, in which the cam drive (5) is provided with an injection onset adjusting device (48), by means of which the beginning of the supply stroke of the pump piston is adjustable.

18. A fuel injection pump as defined by claim 1, in which the fuel injection pump is associated with an injection valve comprising a two-spring injection valve assembly via which the main injection and the preinjection are effected.

19. A fuel injection pump as defined by claim 2, in which the fuel injection pump is associated with an injection valve comprising a two-spring injection valve assembly via which the main injection and the preinjection are effected.

* * * * *